United States Patent [19]

Mori et al.

[11] Patent Number: 4,512,820

[45] Date of Patent: Apr. 23, 1985

[54] IN-PILE PARTS FOR NUCLEAR REACTOR AND METHOD OF HEAT TREATMENT THEREFOR

[75] Inventors: Yasuhiko Mori, Mito; Shigeo Hattori, Ibaraki; Isao Masaoka; Hisao Itow, both of Hitachi, all of Japan

[73] Assignee: Hitachi, Ltd., Tokyo, Japan

[21] Appl. No.: 268,371

[22] Filed: May 29, 1981

[30] Foreign Application Priority Data

May 30, 1980 [JP] Japan ..... 55-73208

[51] Int. Cl.[3] ..... C22C 19/05; C22F 1/10

[52] U.S. Cl. ..... 148/12.7 N; 148/11.5 N; 148/410; 420/446; 376/900

[58] Field of Search ..... 148/11.5 N, 162, 410, 148/12.7 N, 428; 420/447, 446, 442; 376/900

[56] References Cited

U.S. PATENT DOCUMENTS 2,570,193 10/1951 Bieber ..... 420/448

FOREIGN PATENT DOCUMENTS 54-25216 2/1979 Japan ..... 148/162

169741 12/1981 Japan ..... 148/11.5 N

OTHER PUBLICATIONS

European Patent Application, Publication No. 056,480, 7-28-82.

Wirtz, K., *Lectures on Fast Reactors,* TK 9203f3 W57, 1978.

*Primary Examiner*—L. Dewayne Rutledge

*Assistant Examiner*—Debbie Yee

*Attorney, Agent, or Firm*—Antonelli, Terry & Wands

[57] ABSTRACT

In-pile parts for a nuclear reactor made of alloy consisting essentially of by weight 0.01–0.2% C, 10–21% Cr, 1–4% Ti, 0.3–2% Nb, 0.1–2% Al and the balance Ni wherein Ti content being higher than Nb content, said alloy having the microstructure of chromium carbides precipitated in the grain boundaries and a $\gamma'$ phase precipitated in the grains with the matrix thereof being austenite in microstructure.

22 Claims, 7 Drawing Figures

(x 5000)

(x 5000)

IN-PILE PARTS FOR NUCLEAR REACTOR AND METHOD OF HEAT TREATMENT THEREFOR

BACKGROUND OF THE INVENTION

This invention relates to novel in-pile parts for a nuclear reactor made of nickel base alloy and method of heat treatment therefor, and more particularly it relates to in-pile parts for a nuclear reactor made of nickel base alloy which are free from stress corrosion cracking that might take place in pure water of high temperature and high pressure of a light water nuclear reactor and to a method of heat treatment for such parts.

Nickel base alloys are used for in-pile structures of a light water nuclear reactor. Of all the nickel base alloys used for this purpose, Inconel X750 nickel base alloy for the precipitation hardening type, i.e. Aerospace Material Specification (AMS) 5667H, has particular utility as material of high resilience for forming in-pile parts of various types because of its high heat resistance and high strength. This alloy consists of by weight less than 0.08% C, 14–17% Cr, 2.25–2.75% Ti, 0.7–1.2% Nb+Ta, 0.4–1.0% Al, less than 0.5% Si, less than 1% Mn, 5–9% Fe and the balance Ni. The in-pile parts as mounted in a nuclear reactor form a crevice between the parts and are subjected to high stress and exposed to pure water of high temperature and high pressure at all times. Thus, there are the risks that the in-pile parts would be corroded by the pure water and develop stress corrosion cracking due to the existence of crevices and the stress applied thereto.

The in-pile parts that tend to develop such crevice stress corrosion cracking include a finger spring 3 interposed between the tie plate 1 and the channel box 2 in a fuel assembly shown in FIG. 2, an expansion spring 6 for holding a graphite seal 4 in place within an index tube 5 in a control rod drive mechanism shown in FIG. 3 and a hold down beam 9 interposed between arms 8 for pushing downwardly an elbow tube 7 of a jet pump shown in FIG. 4.

A nickel base alloy heretofore used for forming such in-pile parts has been subjected to solution heat treatment, then subjected to aging treatment at a relatively high temperature (approximately 860° C.) and thereafter subjected to aging treatment again at a lower temperature. Experiments conducted by the present inventors have revealed that the nickel base alloy treated in this way is not necessarily high in stress corrosion cracking resistance. In view of the results of the experiments, the present inventors have conducted research that has led to the present invention.

Further, the nickel base alloys used in a condition exposed to pure water of high temperature and high pressure in a light water nuclear reactor are known from U.S. Ser. No. 733,520 (May 31, 1967) and U.S. Pat. No. 3,574,604. However, the former alloy is not preferable because its Cr content is high so that the austenite matrix is unstable and it is liable to form precipitates which are harmful for resistance to stress corrosion cracking at high temperature. With respect to the latter alloy it is confirmed by the present inventors that since Nb content is extremely higher than Ti content the growth of precipitates phase is liable to occur when used at high temperature thereby degrading the stress corrosion cracking resistance.

SUMMARY OF THE INVENTION

Accordingly this invention has as its object the provision of in-pile parts for a nuclear reactor made of nickel base alloy of high stress corrosion cracking resistance and a method of heat treatment therefor.

The in-pile parts according to the invention are made of alloy consisting essentially of by weight 0.01–0.2% C, 10–21% Cr, 1–4% Ti, 0.3–2% Nb, 0.1–2% Al and the balance Ni wherein Ti content being higher than Nb content, said alloy having the structure of chromium carbides precipitated in the grain boundaries and a $\gamma'$ phase precipitated in the grains with the matrix thereof being austenite in microstructure. The characteristic in microstructure of in-pile parts according to the invention is that in the vicinity of grain boundaries there is no zone in which $\gamma'$ phase is not precipitated.

The above alloy is of precipitation hardening type, and Ti and Nb are essential to precipitation hardening and in order to obtain in-pile parts having high strength and high toughness in combination at high temperature, Ti content higher than 1 wt% and Nb content higher than 0.3 wt% are necessary, and when these contents are not fulfilled and when these elements are not added in combination it is impossible to obtain desired 0.2% proof stress of 70 $Kg/mm^2$ at room temperature.

When Ti content and Nb content exceed 4 wt% and 2 wt% respectively, the toughness is reduced sharply and also the stress corrosion cracking resistance is reduced. In order to obtain the stability of precipitates phase at high temperature, the high toughess and the high resistance to stress corrosion cracking it is necessary that Ti content is higher than Nb content.

The Cr content should be at least 10 wt% in the alloy to enable the in-pile parts to be sufficiently resistant to stress corrosion cracking. When the Cr content is over 25 wt%, the alloy would have reduced hot workability and their mechanical properties and corrosion resistance would be reduced due to the development of harmful phases, such as $\sigma$ phase, $\mu$ phase and Laves phase which are known as TCP phases.

The C content higher than 0.01 wt% is necessary to strengthen the matrix, but on the other hand when the C content is over 0.2 wt% the alloy becomes brittle and the stress corrosion cracking resistance is reduced, thus the C content should be less than 0.2 wt%. The C content of 0.02–0.08 wt% is particularly preferable.

The Al content of more than 0.1 wt% is necessary in order to highly strengthen the alloy by forming a $\gamma'$ phase with coexistence of Ti, but on the other hand when the Al content is over 2 wt% the $\gamma'$ phase of excessively large amount is formed thereby reducing the toughness, and thus it should be less than 2 wt%. The Al content of 0.3–1 wt% is particularly preferable.

It is preferable that the Fe is contained in the alloy because if Ti, Nb, Al, Si, Mn, etc. are added in the form of their ferroalloys when the alloy having derived composition is melted the yields of these elements become high. However, the Fe content higher than 10 wt% is not preferable because it has a tendency to reduce the strength of alloy. The Fe content of 5–8 wt% is particularly preferable.

This invention provides a method of heat treatment of in-pile parts for a nuclear reactor characterized by the step of subjecting a material made of alloy consisting essentially of by weight 0.01–0.2% C, 10–21% Cr, 1–4% Ti, 0.3–2% Nb, 0.1–2% Al and the balance Ni and subjected to hot plastic working or a material made of same alloy and subjected to solution heat treatment after hot plastic working to aging treatment in a temperature range in which a $\gamma'$ phase is precipitated in the grains and Cr carbides are precipitated in the grain boundaries.

Solution heat treatment is a pre-treatment for giving a single phase to the alloy so as to enable desirable precipitates to be formed in the subsequent aging treatment. Thus, although it is desirable to completely solutionize the crystalline particles and precipitates formed during casting and forging into the matrix, an extremely high temperature is required for achieving complete solutionization. However, it is not desirable to subject the alloy to solution heat treatment at inordinately high temperature because such high temperature causes the grain growth and as a result reduces strength and toughness and further reduces stress corrosion cracking resistance of the alloy. Nor is it desirable to subject the alloy to solution heat treatment at inordinately low temperature because the sufficient solutionization can not be obtained. Thus, the preferred temperature range is between 1000° and 1250° C., particularly between 1020° and 1150° C.

Aging treatment is performed at such a temperature that a $\gamma'$ phase is uniformly precipitated in the matrix without forming throughout the matrix a zone in which there are no precipitates in order that the intermetallic compound consisting mainly of Ni and Ti is prevented from being precipitated in the grain boundaries in continuous chain form. The $\gamma'$ phase is generally composed of $Ni_3$ (Al, Ti, Nb) intermetallic compound. Chromium carbides are generally $Cr_{23}C_6$. The alloy of this type has hitherto been subjected to heat treatment at a relatively high temperature (about 860° C.) to increase creep strength, and then to aging treatment at a lower temperature to increase strength by causing a $\gamma'$ phase to be precipitated. The present inventors have found that this treatment process causes a reduction in the stress corrosion cracking resistance of the alloy because a special metallic structure is formed as by precipitation of an intermetallic compound in the grain boundaries.

Meanwhile it has been ascertained by the present inventors that when the alloy is subjected to aging treatment to cause a $\gamma'$ phase to be directly precipitated following forging or by solution heat treatment following forging, instead of subjecting it to heat treatment at a relatively high temperature as has been done in the prior art, it is possible to markedly increase the stress corrosion cracking resistance of the alloy, particularly the stress corrosion cracking resistance thereof involving crevices. This finding forms the basis of this invention. The temperature at which the aging treatment is performed is preferably in the range between 650° and 750° C. When the temperature is below 650° C., the aging treatment would be time consuming. Conversely, when the temperature is above 750° C., over-aging softening of the alloy would render its strength low, and the stress corrosion cracking resistance of the alloy would be reduced because its structure would become same as that obtained by heat treatment performed at a relatively high temperature as described hereinabove. Thus the temperature above 750° C. and below 650° C. is not preferable.

It has been known that when austenitic stainless steel or an alloy of Inconel 600 series is subjected to aging in the temperature range of 550°-800° C., chromium carbides are formed and marked stress corrosion cracking occurs. In the present invention, however, it has been found that contrary to what has hitherto been believed, aging treatment of nickel base alloy at a temperature in the range between 650° and 750° C. has the effect of avoiding the development of stress corrosion cracking in the alloy.

DESCRIPTION OF THE PREFERRED EMBODIMENTS

Table 1 shows the chemical composition (weight percent) of an Inconel X750 alloy that is commercially available. This alloy was subjected to the heat treatment of various types, and the treated alloy was tested with the device shown in FIG. 5 for crevice stress corrosion cracking resistance by immersing the alloy in pure water of high temperature (288° C.) and high pressure containing 26 ppm oxygen for 500 hours.

TABLE 1

| C | Si | Mn | P | S | Ni | Cr | Nb | Ti | Al | Fe |
|---|---|---|---|---|---|---|---|---|---|---|
| 0.04 | 0.16 | 0.19 | 0.008 | 0.004 | 72.7 | 15.5 | 0.95 | 2.64 | 0.52 | 6.9 |

Figure 1:
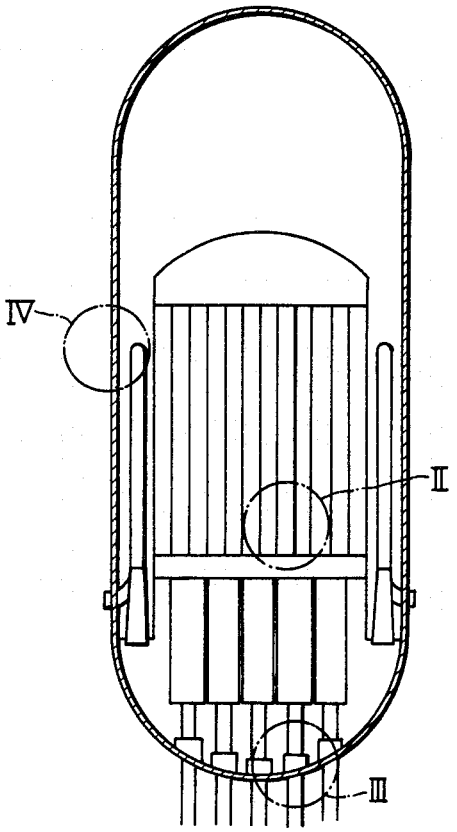
FIG. 1 is a schematic vertical sectional view of a core of boiling-water reactor in which the in-pile parts for a nuclear reactor according to the invention are actually used.
Figure 2:
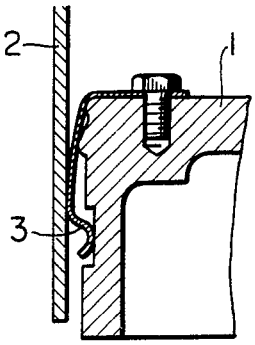
FIG. 2 is a vertically sectioned view, shown on an enlarged scale, of a fuel assembly shown in a circle II in FIG. 1.
Figure 3:
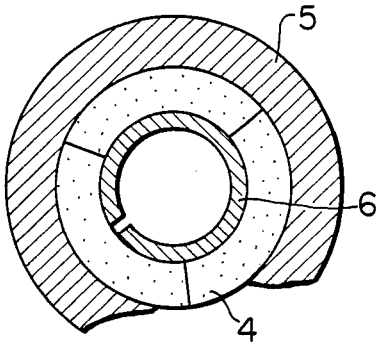
FIG. 3 is a cross-sectional view, shown on an enlarged scale, of a control rod drive mechanism shown in a circle III in FIG. 1.
Figure 4:
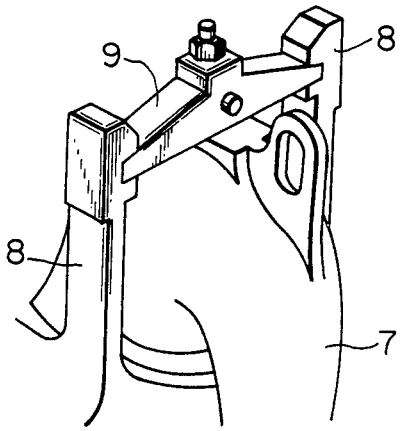
FIG. 4 is a perspective view, shown on an enlarged scale, of a jet pump shown in a circle IV in FIG. 1.
Figure 5:
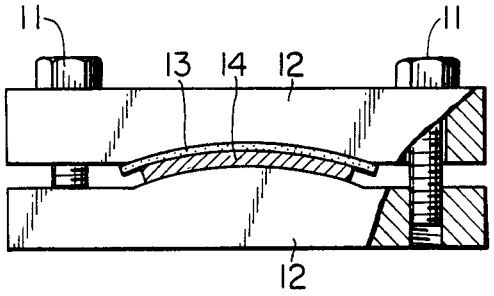
FIG. 5 is a vertically sectioned view of a device used for conducting crevice corrosion tests.

In FIG. 5, keeping jigs 12 made of stainless steel are connected together by bolts 11 while a specimen 14 to be tested is held between the jigs 12 through a graphite member 13, thus bending stress is applied to the specimen 14.

Table 2 shows the relation between solution heat treatment temperature, intermediate heat treatment temperature and aging treatment temperature and the depth of crevice stress corrosion cracking that accelerates stress corrosion cracking.

TABLE 2

| Specimen No. | Solution Heat Treatment Temp. (°C.) | Intermediate Heat Treatment Temp. (°C.) | Aging Treatment Temp. (°C.) | Results of Tests |
|---|---|---|---|---|
| 1 | 982 | 840 | 700 | ● |
| 2 | | 885 | 700 | ● |
| 3 | | None | 650 | ● |
| 4 | | | 700 | ● |
| 5 | | | 750 | ● |
| 6 | 1000 | 840 | 700 | ● |
| 7 | | None | 700 | ● |
| 8 | 1020 | 840 | 700 | ● |
| 9 | | 885 | 700 | ● |

TABLE 2-continued

| Specimen No. | Solution Heat Treatment Temp. (°C.) | Intermediate Heat Treatment Temp. (°C.) | Aging Treatment Temp. (°C.) | Results of Tests |
|---|---|---|---|---|
| 10 | | None | 650 | ○ |
| 11 | | | 700 | ○ |
| 12 | | | 750 | ○ |
| 13 | 1050 | 840 | 650 | ● |
| 14 | | | 700 | ● |
| 15 | | | 750 | ● |
| 16 | | 885 | 650 | ● |
| 17 | | | 700 | ● |
| 18 | | | 750 | ● |
| 19 | | None | 650 | ○ |
| 20 | | | 700 | ○ |
| 21 | | | 750 | ○ |
| 22 | 1100 | 840 | 700 | ● |
| 23 | | None | 700 | ○ |
| 24 | 1150 | 840 | 700 | ● |
| 25 | | None | 700 | ○ |
| 26 | 1200 | 840 | 700 | ● |
| 27 | | None | 700 | ◑ |
| 28 | 1250 | 840 | 700 | ● |
| 29 | | None | 700 | ◑ |
| 30 | Hot forging, | 840 | 700 | ● |
| 31 | Thereafter No Solution Heat Treatment | None | 700 | ◑ |
| 32 | Hot Rolling, | 840 | 700 | ● |
| 33 | Thereafter No Solution Heat Treatment | None | 700 | ◑ |

Depth of Crevice Stress Corrosion Cracking (μm)
○: <50
◑: 50-100
●: >100

The solution heat treatment shown in Table 2 consisted in heating for one hour when it is performed below 1100° C. and for 15 minutes when it is performed over 1150° C. and cooling by water from respective temperatures. Heating time in the intermediate heat treatment at 840° C. and 885° C. was 24 hours, and heating time in the aging treatment at 650°-750° C. was 20 hours.

As can be clearly seen in Table 2, specimens of alloy subjected to intermediate heat treatment of prior art following solution heat treatment developed crevice stress corrosion cracking of a depth of over 100 μm, indicating that they are low in crevice stress corrosion cracking resistance. Also, when the solution heat treatment was carried out at 982° C., the crevice stress corrosion cracking developed had a depth of over 100 μm, due partly to insufficient solutionization, indicating that the specimens are low in crevice stress corrosion cracking resistance. It will also be seen that when the temperature of solution heat treatment was over 1200° C. the specimens showed slightly low resistance to crevice stress corrosion cracking, due probably to the crystal grains becoming coarse. However, it has been ascertained that when the solution heat treatment was carried out sufficiently and aging treatment was carried out without the intermediate heat treatment, the crevice stress corrosion cracking developed had a depth of below 50 μm, indicating that the specimens have excellent crevice stress corrosion cracking resistance.

It has been ascertained that when the alloy was treated by the method according to the invention, the crevice stress corrosion cracking developed had a depth of 50-100 μm even if the alloy was directly subjected to aging treatment following hot forging or hot rolling, indicating that the specimen has improved resistance to crevice stress corrosion cracking. The specimen of the alloy subjected to the solution heat treatment at 1066° C. for one hour and to the aging treatment at 704° C. for 20 hours had following mechanical properties;

| | |
|---|---|
| tensile strength at room temperature: | 118 kg/mm², |
| 0.2% proof stress: | 74 Kg/mm², |
| elongation at rupture: | 32%, and |
| reduction of area at rupture: | 27%. |

Figure 6:
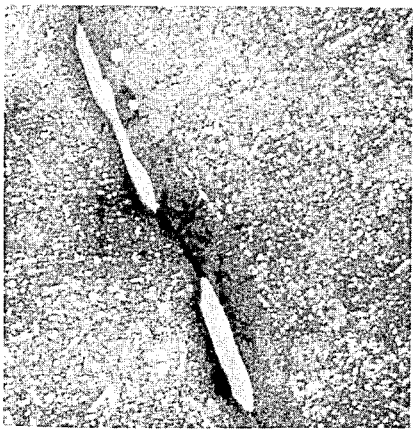
FIG. 6 is a microscopic photograph showing the microstructure of a nickel base alloy subjected to heat treatment by a process of the prior art.

FIG. 6 is a microscopic photograph showing the microstructure of specimen 14 shown in Table 2 of a nickel base alloy subjected to heat treatment according to the prior art (solution heat treatment of 1050° C.×1 hr→intermediate heat treatment of 840° C.×24 hrs→aging treatment of 700° C.×20 hrs). The microstructure shown in this microscopic photograph is characterized by precipitates of intermetallic compound consisting mainly of Ni and Ti precipitated in the grain boundaries and by existence of zone in which there are no precipitates of γ' (gamma prime) and which surrounds said precipitates of intermetallic compound. Further, it is to be noted that the γ' in this microstructure is larger in size than the γ' in a microstructure (directly subjected to aging treatment) presently to be described by referring to FIG. 7.

Figure 7:
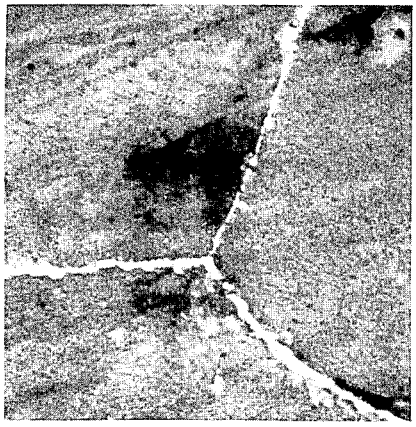
FIG. 7 is a microscopic photograph showing the microstructure of the alloy same as that shown in FIG. 6 that has been subjected to heat treatment by the method according to the invention.

FIG. 7 is a microscopic photograph showing the microstructure of specimen 20 shown in Table 2 of a nickel base alloy subjected to heat treatment according to the invention (solution heat treatment of 1050° C.×1 hr→no intermediate heat treatment→aging treatment of 700° C.×20 hrs). This microstructure is characterized by precipitates of chromium carbides precipitated in the grain boundaries and by existence of ultrafine γ', which can not be detected with a magnification on the order of 5000, precipitated in the matrix.

The in-pile parts for a nuclear reactor according to the invention offer the advantages of preventing the development of stress corrosion cracking in parts of an in-pile structure in which crevices are formed and prolonging their service lives. Such in-pile parts include the following (in the case of a boiling-water reactor):

(1) For jet pump: cross beam, and spring;
(2) For in-pile structure: earthquake-resistant pin of shroud head, and spring for bolt of shroud head;
(3) For control rod drive mechanism: spud coupling, collet finger, collet spring, cup spring, expansion spring for stop seal, expansion spring for outer seal, internal garter spring, clip, and spring at the lower end; and
(4) For fuel: spacer (spacer spring), finger spring, expansion spring, and channel fastener (spring).

From the foregoing description, it will be appreciated that the invention offers the advantage that in-pile parts for a nuclear reactor of high safety can be made of nickel base alloy of the precipitation hardening type having high resistance to stress corrosion cracking in pure water of high temperature and high pressure.

What is claimed is:

1. In-pile parts for a nuclear reactor made of alloy, of precipitation hardening type, consisting essentially of by weight 0.01-0.2% C, 10-21% Cr, 1-4% Ti, 0.3-2% Nb, 0.1-2% Al and the balance Ni wherein Ti content being higher than Nb content, said alloy having the microstructure of chromium carbides precipitated in the grain boundaries and a γ' phase precipitated in the grains such that in the vicinity of the grain boundaries γ' phase is precipitated in all zones, with the matrix thereof being austenite in microstructure, whereby said microstructure provides reduction of stress corrosion cracking of the alloy.

2. In-pile parts for a nuclear reactor as claimed in claim 1, wherein Ti, Nb and Al contents are 2–3%, 0.5–1.5% and 0.3–1% by weight, respectively.

3. In-pile parts for a nuclear reactor as claimed in claim 1, wherein Ti content is higher than two times Nb content.

4. A method of heat treatment of in-pile parts for a nuclear reactor comprising the steps of:

subjecting alloy, of precipitation hardening type, consisting essentially of by weight 0.01–0.2% C, 10–21% Cr, 1–4% Ti, 0.3–2% Nb, 0.1–2% Al and the balance Ni wherein Ti content being higher than Nb content to hot plastic working and subjecting said alloy to aging treatment in a temperature range in which a precipitation of a $\gamma'$ phase in the grains and precipitation of chromium carbides in the grain boundaries are caused to take place, said precipitation of $\gamma'$ phase in the grains being caused to take place such that $\gamma'$ phase is precipitated in all zones in the vicinity of the grain boundaries, whereby said heat treatment provides reduction of stress corrosion cracking of the alloy.

5. A method as claimed in claim 4, wherein the alloy is subjected to hot plastic working with solution heat treatment following the hot plastic working, and wherein solution heat treatment is performed in the temperature range between 1000° and 1250° C. for 60–15 minutes.

6. A method as claimed in claim 4, wherein said aging treatment is performed in the temperature range between 650° and 750° C. for 20 hours.

7. A method as claimed in claim 4, wherein said in-pile parts comprise springs.

8. A method as claimed in claim 4, wherein said in-pile parts comprise pins.

9. In-pile parts for a nuclear reactor as claimed in claim 1, wherein said alloy further includes Fe in an amount up to 10 wt. %.

10. In-pile parts for a nuclear reactor as claimed in claim 9, wherein the Fe is included in an amount of 5–8 wt. %.

11. In-pile parts for a nuclear reactor as claimed in claim 1, wherein the alloy includes 0.02–0.08 wt.% C.

12. In-pile parts for a nuclear reactor as claimed in claim 1, wherein said alloy has a 0.2% proof stress at room temperature that is at least 70 $Kg/mm^2$.

13. In-pile parts for a nuclear reactor as claimed in claim 12, said parts comprising structure of said nuclear reactor adapted to be subjected to pure water of high pressure and high temperature.

14. In-pile parts for a nuclear reactor as claimed in claim 1, said parts comprising structure of said nuclear reactor adapted to be subjected to pure water of high pressure and high temperature.

15. A method as claimed in claim 4, wherein said in-pile parts comprise structure of said nuclear reactor adapted to be subjected to pure water of high pressure and high temperature.

16. In-pile parts for a nuclear reactor as claimed in claim 1, wherein the $\gamma'$ phase is precipitated uniformly throughout the matrix without forming throughout the matrix a zone in which there are no precipitates.

17. A method as claimed in claim 4, wherein the $\gamma'$ phase precipitation is caused to take place such that said $\gamma'$ phase is precipitated uniformly throughout the matrix without forming throughout the matrix a zone in which there are no precipitates.

18. A method as claimed in claim 4, wherein the aging treatment is performed in a temperature range of 650°–750° C.

19. A method as claimed in claim 18, wherein the alloy is subjected to hot plastic working with solution heat treatment following the hot plastic working, and wherein solution heat treatment is performed in the temperature range between 1000° and 1250° C.

20. A method as claimed in claim 4, wherein the alloy is subjected to hot plastic working with solution heat treatment following the hot plastic working, and wherein solution heat treatment is performed in the temperature range between 1000° to 1250° C.

21. A method as claimed in claim 4, wherein the alloy is subjected to hot plastic working with solution heat treatment following the hot plastic working.

22. A method as claimed in claim 4, wherein the alloy is subjected to hot plastic working without solution heat treatment following the hot plastic working.

* * * * *